US009975139B2

(12) United States Patent
Turner et al.

(10) Patent No.: US 9,975,139 B2
(45) Date of Patent: May 22, 2018

(54) CARTRIDGE AND METHOD FOR PRODUCING A CARTRIDGE

(71) Applicant: SULZER MIXPAC AG, Haag (CH)

(72) Inventors: Hayden Turner, Buchs (CH); Victor Clemens, Winterthur (CH)

(73) Assignee: SULZER MIXPAC AG, Haag (CH)

( * ) Notice: Subject to any disclaimer, the term of this patent is extended or adjusted under 35 U.S.C. 154(b) by 0 days. days.

(21) Appl. No.: 15/300,061

(22) PCT Filed: Mar. 25, 2015

(86) PCT No.: PCT/EP2015/056459
§ 371 (c)(1),
(2) Date: Sep. 28, 2016

(87) PCT Pub. No.: WO2015/150196
PCT Pub. Date: Oct. 8, 2015

(65) Prior Publication Data

US 2017/0216874 A1 Aug. 3, 2017

(30) Foreign Application Priority Data

Mar. 31, 2014 (EP) ..... 14162975

(51) Int. Cl.
*B65D 35/22* (2006.01)
*B05C 17/005* (2006.01)
*B05C 17/01* (2006.01)

(52) U.S. Cl.
CPC .. *B05C 17/00583* (2013.01); *B05C 17/00553* (2013.01); *B05C 17/012* (2013.01)

(58) Field of Classification Search
CPC ..... B05C 17/00583; B05C 17/00553; B05C 17/012
(Continued)

(56) References Cited

U.S. PATENT DOCUMENTS 3,948,704 A 4/1976 Evans
5,586,672 A 12/1996 Cebal
(Continued)

FOREIGN PATENT DOCUMENTS

DE 2453503 A1 5/1975
DE 4345573 B4 8/2007
(Continued)

OTHER PUBLICATIONS

English Translation of the International Preliminary Report on Patentability and Written Opinion dated Oct. 13, 2016 in International Application No. PCT/EP015/056459, filed Mar. 25, 2015.
(Continued)

*Primary Examiner* — Lien Ngo
(74) *Attorney, Agent, or Firm* — Global IP Counselors, LLP

(57) ABSTRACT

A cartridge has a reception chamber extending in a longitudinal direction for a medium to be dispensed. The cartridge has a head part and a cartridge wall which bound the reception chamber, the head part having an outlet for the medium. The cartridge wall is at least regionally a film and the head part is a stable-shape part. The head part is sealingly and in particular unreleasably connected to the cartridge wall and the cartridge is a collapsible cartridge. The cartridge can be converted from an expanded state in which the reception chamber has a maximum volume into a collapsed state in which the reception chamber has a minimal volume. The cartridge not yet filled with medium is in a collapsed state. Furthermore, a method of manufacturing such a cartridge is described.

20 Claims, 3 Drawing Sheets

(58) Field of Classification Search
USPC .... 222/94–97, 105, 106, 135–137, 325–327, 222/145.6
See application file for complete search history.

(56) References Cited

U.S. PATENT DOCUMENTS

| | | | | |
|---|---|---|---|---|
| 5,593,066 | A * | 1/1997 | Konu Ma; Ritaro | B05C 17/00506 222/105 |
| 5,873,970 | A | 2/1999 | Konuma et al. | |
| 6,578,738 | B1 | 6/2003 | Keller | |
| 9,579,686 | B2 * | 2/2017 | Springhorn | B05C 17/00586 |
| 2006/0144854 | A1 | 7/2006 | Clemens | |
| 2008/0267538 | A1 | 10/2008 | Stephenson | |
| 2009/0084815 | A1 * | 4/2009 | Paetow | B65D 81/3244 222/94 |
| 2014/0158717 | A1 | 6/2014 | Ettlin | |
| 2014/0174037 | A1 * | 6/2014 | Frey | B05C 17/00516 53/467 |
| 2014/0203023 | A1 * | 7/2014 | Ettlin | B05C 17/00553 220/507 |

FOREIGN PATENT DOCUMENTS

| | | | |
|---|---|---|---|
| EP | 0575272 | A1 | 12/1993 |
| EP | 0992438 | A1 | 4/2000 |
| JP | 2002527310 | A | 8/2002 |
| JP | 2007045466 | A | 2/2007 |
| WO | 2013056873 | A1 | 4/2013 |
| WO | 2013056874 | A1 | 4/2013 |

OTHER PUBLICATIONS

International Search Report and Written Opinion dated Jun. 5, 2015 in International Application No. PCT/EP2015/056459, filed Mar. 25, 2015 (with partial English Translation).

Canadian Office Action dated Oct. 24, 2016 in counterpart CA Patent Application No. 2,942,622, filed Oct. 8, 2015.

* cited by examiner

CARTRIDGE AND METHOD FOR PRODUCING A CARTRIDGE

CROSS-REFERENCE TO RELATED APPLICATIONS

This application is a U.S. National Stage application of International Application No. PCT/EP2015/056459, filed Mar. 25, 2015, which claims priority to EP Application No. 14162975.8, filed Mar. 31, 2014, the contents of each of which is hereby incorporated herein by reference.

BACKGROUND

Field of Invention

The present invention relates to a cartridge for a medium The invention is furthermore related to a method of manufacturing, and in particular additionally of filling such a cartridge.

Background Information

In the industrial sector, in the construction industry, for example of buildings, and also in the dental sector, cartridges are frequently used to store flowable liquids, frequently pasty or viscous to highly viscous substances and to dispense them for the respective application as required. Examples for such substances are joint sealing compounds, compounds for chemical dowels or chemical anchors, adhesives, pastes or impression materials in the dental sector. These cartridges are usually produced from plastic and are manufactured in an injection molding process.

A distinction is made between single-component systems in which the material to be dispensed is only made of one component and two-component or multicomponent systems in which at least two different components are stored in separate chambers of the same cartridge or in separate cartridges, wherein the components are intimately mixed on dispensing by means of a dynamic or static mixing apparatus. Examples for this are two-component adhesives or chemical dowels which only harden after the mixing of the two components. Two-component systems are in particular also used in the industrial sector for paints which are often used to generate functional protective layers such as for corrosion protection.

It is frequently the case that the cartridges include one (or more) axially displaceable conveying pistons by whose movement the material is dispensed from the chamber or chambers. It is understood that the chambers have to have sufficiently thick walls for this purpose in order to be able to withstand the pressure arising on the dispensing. In addition, the cartridges have to have sufficiently substantial wall thicknesses to be sufficiently diffusion-resistant. This is in particular important with respect to the storage to prevent a diffusing in or a diffusing out of the chemical substances and thus a degradation of the cartridge content as effectively as possible. Since such plastic cartridges are as a rule only designed for a single use, a substantial amount of waste results both with regard to volume and to mass, which is in particular also disadvantageous under aspects of environmental protection.

A known alternative to the plastic cartridges is represented by hoses in which the respective materials are stored. These hoses are then placed into a special support apparatus or dispensing apparatus to dispense their contents for the respective application. Such hoses are admittedly in particular much more favorable than cartridges from a waste volume aspect, but they have other disadvantages. Much more complex filling apparatuses are required to fill and close the hoses. In addition, their storage is more problematic since hoses are not able to stand so that special measures or packaging have to be provided for the storage. Problems with the leak tightness of such hoses can also occur. In addition, the mass of the residual volume in the hose which cannot be dispensed is relatively high. Hoses furthermore have the disadvantage that they are very sensitive toward mechanical influences, in particular toward sharp edges or pointed corners.

In addition to the aspect of environmental protection, the topic of sustainability is also increasingly gaining importance. The use of renewable starting materials, the minimization of the use of raw materials and energy as well as a reduction of waste which is as high as possible are increasingly gaining importance both with regard to the cartridge per se and to the volume of residual mass remaining in the cartridge.

The unfilled cartridges are traditionally transported by the cartridge manufacturers to the manufacturers of the filling materials (media) who then take care of the filling of the empty cartridges. Even though the unfilled cartridges have a relatively low weight, the costs for the transport of the empty cartridges from the cartridge manufacturers to the media manufacturers are relatively high since the empty cartridges have a relatively large volume and thus high space requirements on transport. The storage costs for the empty cartridges both at the cartridge manufacturers' and at the media manufacturers' are furthermore also relatively high due to the space requirements. These costs make up a not insubstantial portion of the total manufacturing costs of the cartridges.

SUMMARY

It is therefore an object of the invention to propose a cartridge of the initially named kind and a method of manufacturing such a cartridge by which the total manufacturing costs can be reduced.

In accordance with the invention, this object is satisfied by a cartridge having a reception chamber extending in a longitudinal direction for a medium to be dispensed having a head part and a cartridge wall which bound the reception chamber, wherein the head part has an outlet for the medium, the cartridge wall is configured at least regionally as a film and the head part is configured as a stable-shape part and the head part is sealingly connected to the cartridge wall, with the cartridge being configured as a collapsible cartridge, i.e. with it being able to be converted from an expanded state in which the reception chamber has a maximum volume into a collapsed state in which the reception chamber has a minimal volume. Additionally, this object is satisfied a method of manufacturing such a cartridge.

The space requirements of a still unfilled cartridge can be reduced by the invention, depending on the maximum filling volume, to a fraction, for example to less than 30%, in particular less than 25%, preferably less than 20%, of the space requirements of a customary cartridge or of the cartridge in the expanded state. The space requirements of a still unfilled cartridge can equally be reduced, depending on the maximum filling volume of the reception chamber, to a fraction, for example to less than 30%, in particular less than 25%, preferably less than 20%, of the space requirements of the reception chamber in the expanded state. In accordance with the invention, the recognition is utilized that the flexible cartridge wall of a collapsing cartridge cannot only be pushed together on the dispensing of the filling compound from the filled cartridge, but that a cartridge which has not yet even been filled, can also be collapsed in a corresponding manner. The volume of the cartridge or of its reception chamber can thus simultaneously be minimized so that the storage and transport costs can be considerably reduced due to the reduced space requirements. Since the collapsed cartridge can be converted into their expanded state at any time without problem, the expansion, and the associated increase in the volume, of the reception space are only necessary when the cartridge is filled with the filling compound. The space requirements of the cartridge/reception chamber are not to be understood as the internal volume of the cartridge/reception chamber, but rather the volume of the virtual shell (convex shell) surrounding the cartridge/reception chamber or of the space which surrounds the cartridge/reception chamber and which is required for the storage and/or for the transport of the cartridge/reception chamber.

The connection between the head part and the cartridge wall can be realized, for example, by adhesive bonding, fusing, welding or by clamping. It is also possible that the head part is injection molded to the cartridge wall, in particular to its end-face end and that thus the head part and the cartridge wall are configured in one piece. The end of the cartridge wall remote from the head part is configured as closed for forming the reception chamber. In this respect, the closed end can be produced directly on the production of the film hose. It is, however, also possible that this end is first configured as open and is subsequently closed in a further method step. This can take place, for example, by adhesive bonding, crimping, fusing, welding, by clamping, for example by means of a clamping ring, or by attaching a separate terminal element such as an end plate.

The configuration of the cartridge wall as a film means, on the one hand, a substantial reduction in waste and of the raw materials required for the manufacture and, on the other hand, brings about a very high flexibility with respect to the material selection. The film can be adapted to the specific cartridge content in dependence on the application and simultaneously represents a very efficient diffusion barrier. The cartridge in accordance with the invention can preferably be placed into a reusable support cartridge on the filling and/or on the dispensing of its content. The film forming the cartridge wall can preferably be configured as a multilayer system, in particular as a composite film. In this respect, the film can comprise plastic layers and/or metallic layers, in particular one or more aluminum layers.

In accordance with a preferred embodiment of the invention, the cartridge wall is pushed together in the longitudinal direction of the reception chamber in the collapsed state of the cartridge. A shortening of the cartridge is thereby automatically achieved which corresponds to an ideal reduction of the space requirements. Furthermore, the pushing together in the longitudinal direction corresponds to the pushing together of the cartridge wall on the dispensing of the filling compound so that the cartridge wall does not have to be especially configured in order also to allow the pushing together of the unfilled cartridge. It is generally also conceivable that the cartridge wall is reshaped in a different manner to achieve the collapsed state. For example, the cartridge wall could be deformed, and in particular pushed together, transversely, and in particular perpendicular, to the longitudinal axis of the reception chamber. This could be achieved, for example, in that a partial vacuum or full vacuum is generated in the unfilled reception space by which a collapsing of the cartridge wall transversely to the longitudinal direction of the reception chamber takes place. Subsequently, the cartridge wall pressed flat in this manner could, for example, be rolled together or folded together to achieve a length shortening of the cartridge.

The cartridge is preferably configured as a single-component cartridge having a reception chamber or as a multicomponent cartridge having a plurality of reception chambers, in particular as a two-component cartridge having two reception chambers. The reception chambers can in this respect in particular have a cylindrical shape and can be arranged next to one another in the case of a multicomponent cartridge. It is also possible that the reception chambers have a shape differing from the cylindrical shape and are in particular configured such that they produce a cylindrical shape together arranged next to one another.

In the case of a multicomponent cartridge, a separate head part is preferably associated with each reception chamber and its outlet is respectively in fluid communication with the reception chamber associated with it. It is, however, also possible that a uniform, common head part is associated with the reception chambers, with the head part having a plurality of outlets of which a respective one is in fluid communication with one respective reception chamber.

The head part is preferably injection molded to the cartridge wall. A single-piece configuration and thus a very tight and stable connection of the head part and the cartridge wall is thereby achieved. The end of the cartridge wall disposed remote from the head part is advantageously sealingly closed by a crimp connection or clamping connection. The originally open end of the hose-like cartridge wall can be sealed simply, inexpensively and reliably in this manner.

In the method in accordance with the invention, the cartridge wall is first sealingly and unreleasably connected to the head part such that the cartridge is produced in its expanded state. The cartridge wall is only pushed together after the production of the cartridge in its expanded state so that the cartridge is converted into its collapsed state in which the reception chamber has its minimal volume. This is completely contrary to the previously known procedures for manufacturing a cartridge in which the empty cartridge is always produced with its maximum filling volume. It was only recognized within the framework of the present invention that the production of the empty cartridges in the collapsed state can result in substantial cost savings in the storage and in the transport and that nevertheless the maximum filling volume for the filled cartridge can be manufactured without problem in that the cartridge is only brought from its collapsed state into the expanded state directly before the filling or during and in particular directly by the filling.

In accordance with a preferred embodiment of the invention, the end of the cartridge wall disposed remote from the head part is sealingly closed prior to the pushing together. This can already take place, for example, directly on the manufacture of the hose-like cartridge wall in that an end of the cartridge wall is manufactured as closed. It is, however, also possible that the cartridge wall is first manufactured with two open ends and the end disposed remote from the head part is only closed at a later time, such as was already stated further above.

The cartridge wall is advantageously pushed together in the longitudinal direction of the reception chamber. It is in particular preferred in this respect that a predefined pressure is generated in the reception chamber and that the pushing together of the cartridge wall takes place against the pressure. The pressure is further preferably gradually reduced on the pushing together and the pressure is in particular selected so high that the cartridge wall is substantially folded together like a concertina on the pushing together. A controlled pushing together of the cartridge wall is thereby ensured which in turn allows a problem-free pushing apart of the cartridge wall on the filling. As already described, it is generally also conceivable that the cartridge wall is reshaped in a different manner to achieve the collapsed state. For example, the cartridge wall could be deformed, and in particular pushed together, transversely, and in particular perpendicular, to the longitudinal axis of the reception chamber.

The medium is further preferably introduced into the reception chamber through the outlet in the head part for filling the cartridge. It is thereby ensured that the reception chamber is in particular reliably filled with medium in the region of the outlet.

The cartridge wall is advantageously pushed apart again by the filling of the cartridge so that the cartridge is converted from its collapsed state into a partly expanded state or into its expanded state. No separate method step is thus required for the expansion of the cartridge since the expansion and the filling are implemented in a common method step.

BRIEF DESCRIPTION OF THE DRAWINGS

Referring now to the attached drawings which form a part of this original disclosure.

DETAILED DESCRIPTION OF THE EMBODIMENTS

Figure 1:
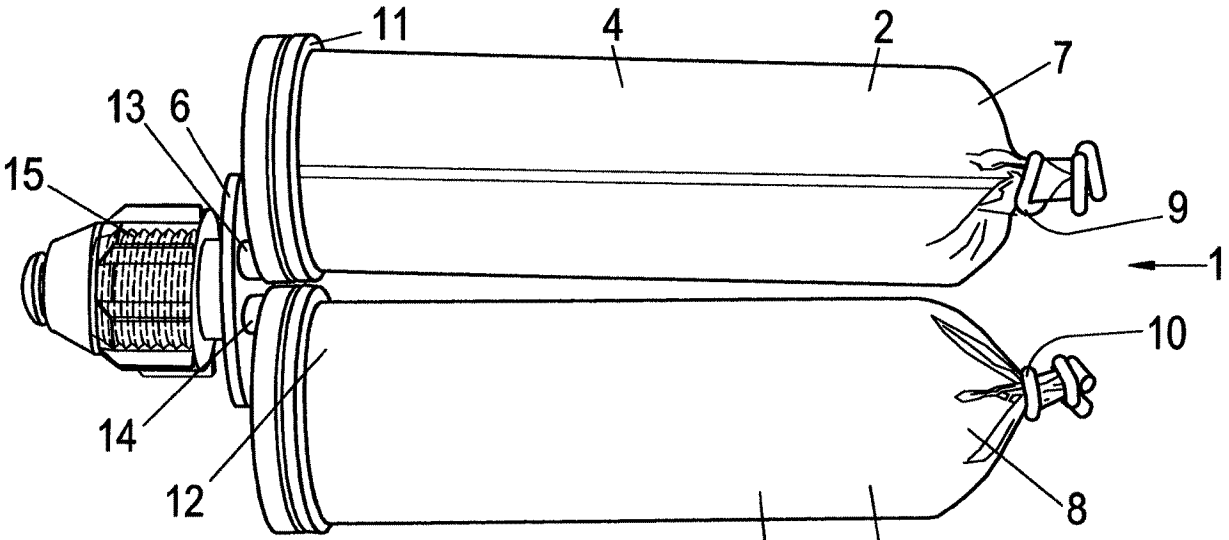
FIG. 1 is a two-component cartridge in accordance with the invention in its expanded state.

FIG. 1 shows a cartridge 1 which is configured as a two-component cartridge and which comprises two cylindrical reception chambers 2, 3. The reception chambers 2, 3 are each bounded by a cartridge wall 4, 5 and by a common head part 6 which respectively forms an end-face end of each reception chamber 2, 3. The two ends 7, 8 of the two cartridge walls 4, 5 disposed remote from the head part 6 are each led together toward the center axis of the respective reception chamber 2, 3 and are thus bound together by a respective clamping ring 9, 10 such that the ends 7, 8 are sealingly closed.

The ends 11, 12 facing the head part 6 are sealingly and unreleasably connected to the head part 6 in that the head part 6 is injection molded to the ends 11, 12. Whereas the head part 6 comprises a stable-shape plastic, the cartridge walls 4, 5 are configured as multilayer films which are each rolled to a cylindrical shape in their predominantly center regions and are welded and form together with the head part 6 the cylindrical reception chambers 2, 3.

The head part 6 has two outlets 13, 14 which are connected to the reception chambers 2, 3 for filling them with filling compound and for dispensing the filling material out of the reception chambers 2, 3. A screw cap 15 is furthermore provided by which the outlets 13, 14 are closed together.

In FIG. 1, the reception chambers 2, 3 are still not yet filled with filling compound, i.e. with the medium to be dispensed, but are empty. The cartridge walls 4, 5 nevertheless have the substantially cylindrical shape shown in FIG. 1 due to the stiffness of the used film material, said cylindrical shape representing the expanded state of the cartridge 1 with a maximum volume of the reception chambers 2, 3.

Figure 2:
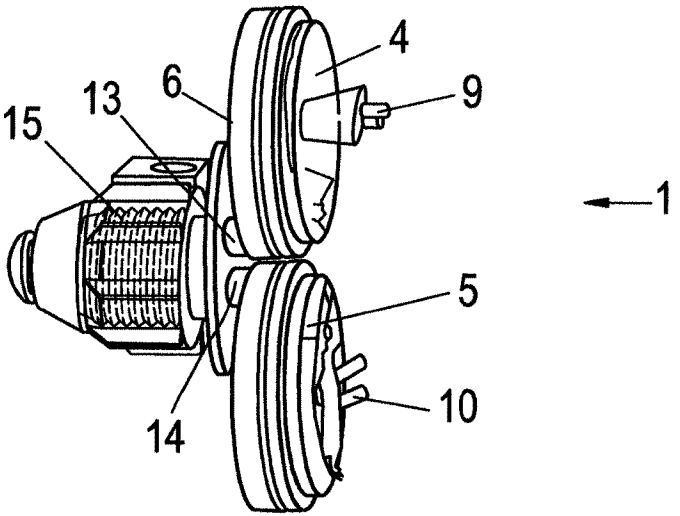
FIG. 2 is the cartridge in accordance with FIG. 1 in its collapsed state.

In accordance with the invention, the cartridge walls 4, 5 are pushed together in the longitudinal direction of the reception chambers 2, 3 even before the filling with the medium to be dispensed until the cartridge adopts its collapsed state in which the reception chambers 2, 3 each have their minimal volumes. This collapsed state is shown in FIG. 2. It immediately becomes clear from the comparison of FIGS. 1 and 2 that the space requirements of the cartridge 1 or of the reception chambers 2, 3 in the collapsed state only amounts to approximately 20% of the space requirements in the expanded state. The pushing together of the cartridge walls 4, 5 can in this respect, in particular with an unscrewed screw cap 15, take place a dispensing apparatus described in more detail in the following.

Figure 3:
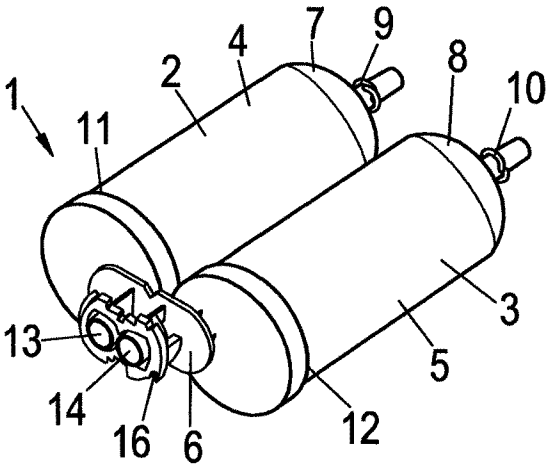
FIG. 3 is a cartridge in accordance with the invention without a closure cap.

FIG. 3 shows a cartridge 1 slightly modified with respect to FIGS. 1 and 2. The only difference is that no screw connection is provided in the region of the outlets 13, 14 for fastening the screw cap 15, but rather a bayonet fastening is provided for fastening a closure cap with a bayonet coupling. The embodiment of the fastening type by a screw connection or by a bayonet fastening is not relevant to the present invention. Furthermore, a bayonet fastener also comprises, in addition to a plug-in movement, a rotational or screw movement subsequent thereto so that in the following, for simplification, the terms "screw cap" and "screw attachment" are used uniformly even if a bayonet fastening of the closure cap is shown. It can be recognized in FIG. 3 on the basis of the removed screw cap 15 that the outlets 13, 14 extend up to an end-face free end of a screw attachment 16 onto which the screw cap 15 can be screwed. A frontal filling of the cartridge 1 in its collapsed state is possible via the outlets 13, 14, with the cartridge 1 automatically being converted into its expanded state shown in FIG. 3 by the filled-in medium.

Figure 5:
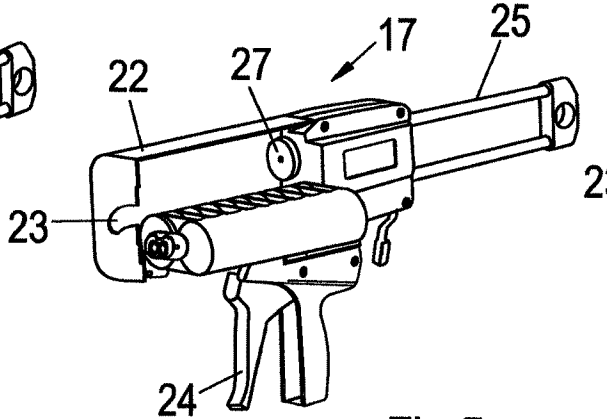
FIG. 5 is the dispensing apparatus in accordance with FIG. 4 with a partly inserted cartridge in accordance with FIG. 3.
Figure 4:
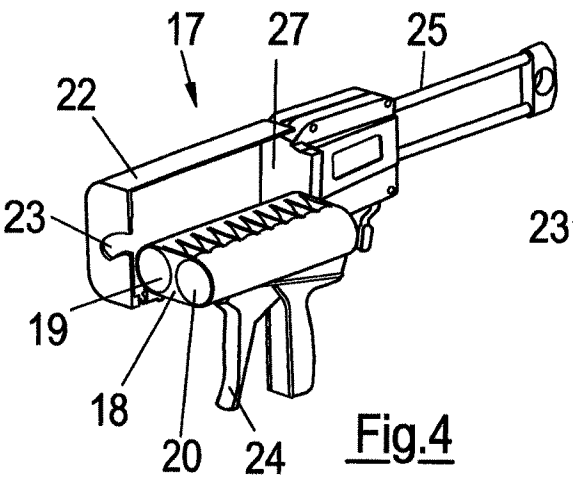
FIG. 4 is an open dispensing apparatus for a cartridge in accordance with the invention without an inserted cartridge.

FIG. 4 shows a dispensing apparatus 17 into which the cartridge 1 in accordance with the invention is inserted. The dispensing apparatus 17 comprises a two-component support cartridge 18 at whose end face two reception openings 19, 20 for the cartridge 1 are formed. As shown in FIG. 5, the cartridge walls 4, 5 of the cartridge 1 can be pushed so far into the reception openings until the head part 6 contacts the end face of the support cartridge 18.

Figure 6:
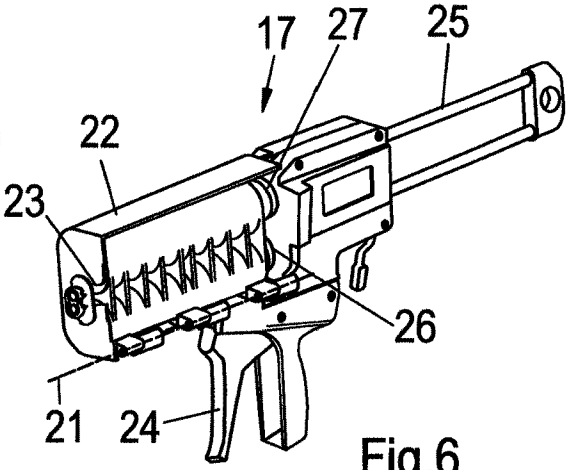
FIG. 6 is the dispensing apparatus in accordance with FIGS. 4 and 5 with a completely inserted cartridge ready for dispensing.

Subsequently, the support cartridge 18 can be pivoted together with the pushed-in cartridge 1 about a pivot axis 21 so that it comes to lie in the interior of a housing section 22 of the dispensing apparatus 17, as is shown in FIG. 6. The screw attachment 16 in this respect projects through an end-face opening 23 in the housing section 22 so that a mixer tip not shown can be screwed onto the screw attachment 16 for dispensing the medium present in the reception chambers 2, 3. Subsequently, in a manner known per se, a ratchet pusher 25, at whose front end two plate-like advancing pistons 26, 27 are provided, can be displaced toward the front end of the dispensing apparatus 17 by a repeated actuation of an actuation lever 24, whereby the filling compound present in the reception chambers 2, 3 are dispensed through the outlets 13, 14 and are subsequently mixed by the mixer tip.

Figure 7:
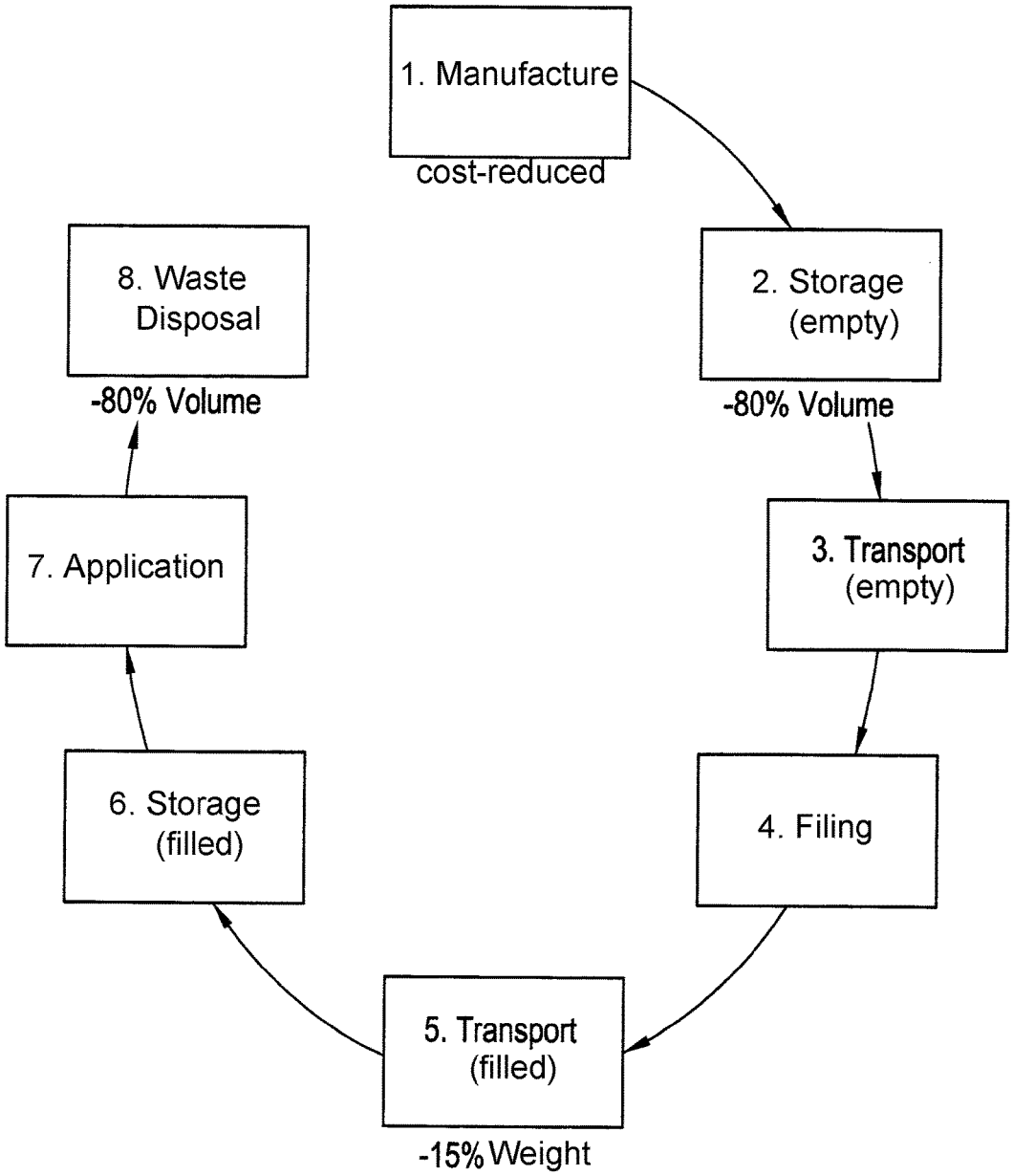
FIG. 7 is a schematic flowchart of the manufacture and of the use of a cartridge in accordance with the invention.

It is indicated in a step 1 "Manufacture" from FIG. 7 that manufacturing costs can clearly be saved by the configuration of the cartridge wall as a film in contrast with a cartridge with a stable-shape cartridge wall. By the conversion of the empty cartridge into its collapsed state directly after its manufacture, the space requirements in accordance with step 2 "Storage (empty)" are reduced by approximately 80%, whereby the storage costs are correspondingly reduced. In a corresponding manner, approximately 80% of volume and weight is saved on the transport of the empty, collapsed cartridges to the media manufacturers, as is indicated in step 3 "Transport (empty)". The cartridges are only expanded again on the subsequent filling of the cartridges (step 4 "Filling") so that only a 15% weight reduction is given due to the film used in the subsequent transport (step 5 "Transport (filled)". The following steps 6 "Storage (filled)!" and 7 (Application)" then take place in a known manner, while in step 8 "Waste disposal" an approximately 80% volume reduction is in turn present with respect to cartridges with a shape-stable cartridge wall.

The invention claimed is:

1. A cartridge before filled with a medium comprising:

a reception chamber extending in a longitudinal direction for the medium to be dispensed, having a head part and a cartridge wall which bound the reception chamber, the head part having an outlet for the medium, the cartridge wall being configured at least regionally as a film and the head part being configured as a stable-shape part and the head part sealingly connected to the cartridge wall, with the cartridge being configured as a collapsible cartridge so as to be able to be converted from an expanded state in which the reception chamber has a maximum volume into a collapsed state in which the reception chamber has a minimal volume, the cartridge not yet filled with the medium being in the collapsed state, a diameter of the cartridge not yet filled remaining substantially constant upon conversion from the expanded state to the collapsed state, and the space requirements of at least one of the not yet filled reception chamber and the not yet filled cartridge in the collapsed state only amounting to 30% or less of the respective space requirements of the reception chamber or the cartridge in the expanded state.

2. The cartridge in accordance with claim 1, wherein the cartridge wall is pushed together in the longitudinal direction of the reception chamber in the collapsed state of the cartridge.

3. The cartridge in accordance with claim 1, wherein the cartridge is configured as a single-component cartridge having a reception chamber or as a multicomponent cartridge having a plurality of reception chambers.

4. The cartridge in accordance with claim 1, wherein the cartridge is configured as a multicomponent cartridge having a plurality of reception chambers, and wherein a separate head part is associated with each of the plurality of reception chambers and an outlet of a respective head part is respectively in fluid communication with the reception chamber associated with the respective head part.

5. The cartridge in accordance with claim 1, wherein the cartridge is configured as a multicomponent cartridge having a plurality of reception chambers, and wherein a uniform common head part is associated with the plurality of reception chambers, with the head part having a plurality of outlets of which a respective outlet is in fluid communication with a respective one of the plurality of reception chambers.

6. The cartridge in accordance with claim 1, wherein the head part is injection molded to the cartridge wall; and wherein an end of the hose-shaped cartridge wall disposed remote from the head part is sealingly closed by a crimp connection or by a clamp connection.

7. A method of manufacturing the cartridge in accordance with claim 1, the method comprising:

sealingly and unreleasably connecting the cartridge wall to the head part thereby producing the cartridge in the expanded state; and pushing the cartridge wall together after the production of the cartridge in the expanded state such that the cartridge is converted into the collapsed state in which the reception chamber has the minimal volume.

8. The method in accordance with claim 7, further comprising at least one of storing and transporting the cartridge not yet filled with the medium to a filling apparatus in the collapsed state.

9. The method in accordance with claim 7, further comprising sealingly closing an end of the cartridge wall disposed remote from the head part before the pushing.

10. The method in accordance with claim 7, wherein the pushing the cartridge wall together includes pushing in the longitudinal direction of the reception chamber.

11. The method in accordance with claim 7, further comprising generating a predefined pressure in the reception chamber and the pushing of the cartridge wall takes place against the pressure.

12. The method in accordance with claim 11, further comprising gradually reducing the pressure on the pushing.

13. The method in accordance with claim 12, further comprising selecting the pressure so that the cartridge wall is substantially folded together in a concertina manner on the pushing.

14. The method in accordance claim 7, further comprising filling the medium into the reception chamber through the outlet in the head part for filling the cartridge.

15. The method in accordance with claim 14, further comprising pushing the cartridge wall apart again by the filling of the cartridge so that the cartridge is converted from its collapsed state into a partly expanded state or into the expanded state.

16. The cartridge in accordance with claim 1, wherein the head part is sealingly and unreleasably connected to the cartridge wall.

17. The cartridge in accordance with claim 1, wherein the cartridge wall is pushed together in a concertina manner in the longitudinal direction of the reception chamber in the collapsed state of the cartridge.

18. The cartridge in accordance with claim 1, wherein the cartridge is configured as a two-component cartridge having two reception chambers.

19. A method of manufacturing a cartridge before filled with a medium having a reception chamber extending in a longitudinal direction for the medium to be dispensed having a head part and a cartridge wall which bound the reception chamber, the head part having an outlet for the medium, the cartridge wall is configured at least regionally as a film and the head part is configured as a stable-shape part and the head part is sealingly connected to the cartridge wall, with the cartridge being configured as a collapsible cartridge so as to be able to be converted from an expanded state in which the reception chamber has a maximum volume into a collapsed state in which the reception chamber has a minimal volume, and the cartridge not yet filled with the medium being in the collapsed state, the method comprising:

sealingly and unreleasably connecting the cartridge wall to the head part thereby producing the cartridge in the expanded state;

pushing the cartridge wall together after the production of the cartridge in the expanded state such that the cartridge is converted into the collapsed state in which the reception chamber has the minimal volume, while the cartridge is not yet filled with the medium; and at least one of storing and transporting the cartridge not yet filled with the medium to a filling apparatus in the collapsed state.

20. A method of manufacturing a cartridge before filled with a medium having a reception chamber extending in a longitudinal direction for the medium to be dispensed having a head part and a cartridge wall which bound the reception chamber, the head part having an outlet for the medium, the cartridge wall is configured at least regionally as a film and the head part is configured as a stable-shape part and the head part is sealingly connected to the cartridge wall, with the cartridge being configured as a collapsible cartridge so as to be able to be converted from an expanded state in which the reception chamber has a maximum volume into a collapsed state in which the reception chamber has a minimal volume, and the cartridge not yet filled with the medium being in the collapsed state, the method comprising:

sealingly and unreleasably connecting the cartridge wall to the head part thereby producing the cartridge in the expanded state;

pushing the cartridge wall together after the production of the cartridge in the expanded state such that the cartridge is converted into the collapsed state in which the reception chamber has the minimal volume, while the cartridge is not yet filled with the medium;

generating a predefined pressure in the reception chamber and the pushing the cartridge wall together takes place against the pressure; and gradually reducing the pressure during the pushing.

* * * * *